United States Patent [19]

Astier

[11] Patent Number: 4,817,249

[45] Date of Patent: Apr. 4, 1989

[54] CLOTHING ORNAMENTATION DEVICE ADAPTED TO BE FITTED TO A BUTTON PASSED THROUGH A BUTTONHOLE

[76] Inventor: Pierre Astier, 76, rue de Crimée, 75019 Paris, France

[21] Appl. No.: 165,495

[22] Filed: Mar. 8, 1988

[30] Foreign Application Priority Data

Mar. 12, 1987 [FR] France ..... 87 03377

[51] Int. Cl.[4] ..... A44B 1/12

[52] U.S. Cl. ..... 24/113 MP; 24/41

[58] Field of Search ..... 24/113 MP, 113 R, 90 A, 24/90 TA, 90 E, 98, 41, 42, 43

[56] References Cited

U.S. PATENT DOCUMENTS

| | | | |
|---|---|---|---|
| 306,199 | 10/1884 | Williams | 24/43 |
| 527,062 | 10/1894 | Howe | 24/98 |
| 818,616 | 4/1906 | Dunlap | 24/41 |
| 2,042,416 | 5/1936 | Weindel, Jr. | 24/113 R |
| 2,906,045 | 9/1959 | Stein . | |
| 2,924,037 | 2/1960 | Patrick . | |
| 2,983,975 | 5/1961 | Hubbell . | |
| 3,343,230 | 9/1967 | Darvis . | |
| 4,035,874 | 7/1977 | Liljendahl | 24/113 MP |

FOREIGN PATENT DOCUMENTS

| | | | |
|---|---|---|---|
| 484320 | 6/1977 | Australia . | |
| 2919023 | 11/1980 | Fed. Rep. of Germany | 24/113 MP |
| 2298289 | 8/1976 | France . | |

*Primary Examiner*—Victor N. Sakran

*Attorney, Agent, or Firm*—Browdy and Neimark

[57] ABSTRACT

A clothing ornamentation device adapted to be fitted to a button inserted in a buttonhole including a cylindrical body which is hollow on the inside in order to house or maintain in position a button so that the periphery of the latter can serve as a guide and its axis serves as a rotation axis for the cylindrical body. One end of the body serves as a decorative device or support therefor, and the second end being provided with a perpendicular strip forming a lug substantially in the direction of the generatrices of the cylindrical body and constituting the start of an open ring parallel to the second end terminating in a short ramp provided with a dull point.

2 Claims, 2 Drawing Sheets

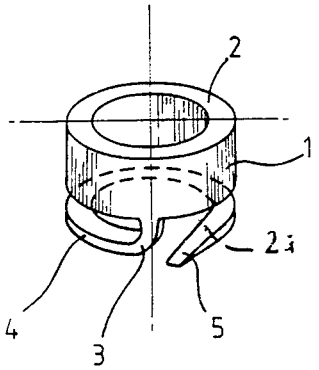
FIG.1
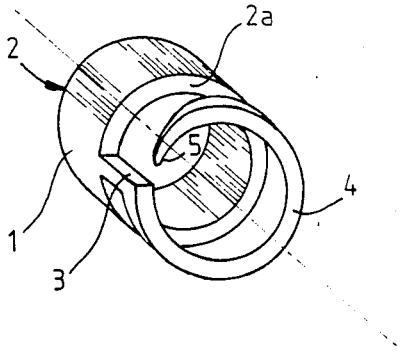
FIG.2
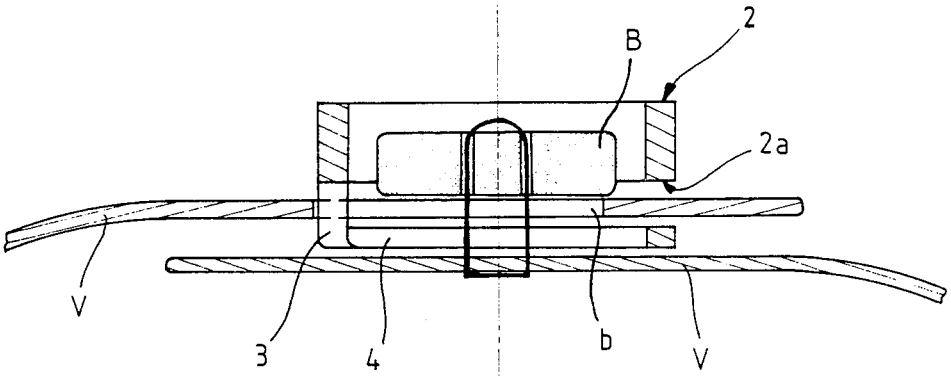
FIG.3
FIG.4
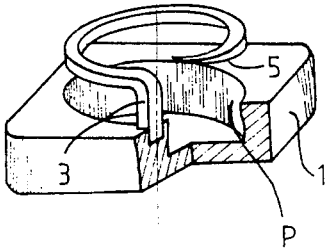
FIG.5
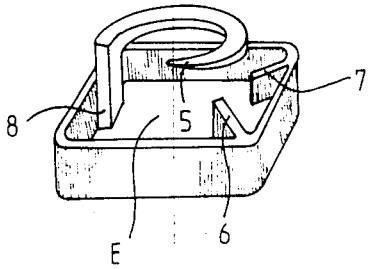
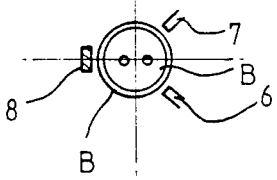
FIG.6

CLOTHING ORNAMENTATION DEVICE ADAPTED TO BE FITTED TO A BUTTON PASSED THROUGH A BUTTONHOLE

BACKGROUND OF THE INVENTION

1. Field of the Invention

The present invention concerns a jewellery item type clothing ornamentation device adapted to be fitted to a button passed through a buttonhole.

2. The Prior Art

There are already known jewellery item type clothing ornamentation devices serving as button covers. The fitting arrangements of these devices are highly diverse and generally comprise casings which cap or enclose the button to be hidden. It will thus be obvious that the jewellery item suffers the same fate as the button should this become unstitched, detached or torn off the garment to which it is fitted, or lost in some other fashion. This non-negligible disadvantage is all the more serious if the jewellery item is of any significant value. (U.S. Pat. Nos. 3,343,230; 2,906,045-Australian Pat. Nos. 484320 and 2983975-French Pat. No. 2298289.)

To alleviate this disadvantage the present invention proposes to confer on the fitting means of such jewellery items a greater guarantee against the risk of loss in that these fitting arrangements cooperate not only with the button itself but also with the portion of the garment in which the buttonhole is formed, so that once the jewellery item is fitted it is attached both to the button and to the buttonhole through which it is passed. It follows that, should the button become detached from the garment carrying it for any reason, the jewellery item and the button it covers would still be attached to said garment at one attachment or fixing point at least.

There are also known systems which use as the means of fixing to the garment simple springs or spirals which have the disadvantage of being very fragile, of pulling on the button stitches and of jamming when fitted, so damaging the buttonhole. Also, said systems can only with difficulty hold the jewellery item appropriately oriented on the garment (see U.S. Pat. No. 2,924,037).

SUMMARY OF THE INVENTION

The present invention covers a jewellery item that is simple, rugged and solid and does not have the aforementioned disadvantages, being easy to fit to the garment by a single rotation onto a button passed through a buttonhole, characterised in that it comprises a cylindrical body that is partially or totally hollow on the inside in order to accommodate and hold in position a button, so that the periphery of the latter can serve as a guide and its axis serve as an axis of rotation for said cylindrical body, a first end of the latter being or itself constituting the jewellery item or the jewellery decoration or serving as a support or fixing for the decorative, ornamental jewellery item proper or possibly various objects, the second end being provided with a strip forming a lug substantially in the direction of the generatrices of said cylindrical body, perpendicular to the latter, passing through the buttonhole, this lug being intended to immobilise the part in rotation in both directions when the jewellery item is in place and constituting the start of an open ring, in a plane parallel to said second end and terminating in a short helical ramp diverging from said second end and having its end formed into a dull point.

In accordance with another characteristic, the non-hollow internal part of the cylindrical body constitutes areas intended to serve as abutment areas for at least three sectors of the periphery of a button inserted into the interior of said cylindrical body.

BRIEF DESCRIPTION OF THE DRAWINGS

Other characteristics and the advantages of the invention will emerge more clearly from the following description given with reference to the appended drawings in which:

FIG. 1 a perspective view of a device in accordance with the invention;

FIG. 2 is another perspective view of the same device in accordance with the invention;

FIG. 3 is a view to a larger scale in elevation and axial cross-section of a device in accordance with the invention mounted on a button passed through a buttonhole showing the perpendicular lug passing through the buttonhole together with the open ring situated in a plane parallel to the second end;

FIG. 4 is a perspective view of one possible embodiment of a jewellery item implementing the invention;

FIG. 5 is a view analogous to FIG. 4 showing an alternative embodiment;

FIG. 6 is a plan view showing the position of a button in a device implemented according to the embodiment shown in FIG. 5;

DETAILED DESCRIPTION OF THE PREFERRED EMBODIMENT

Referring to these drawings, the device in accordance with the invention comprises a cylindrical body 1 that can be hollowed out entirely as shown in FIGS. 1, 2 and 4 in particular or partially hollowed out as shown in FIG. 5, for example. The role and the function of this cylindrical body are to provide a housing into which a button B can be inserted and held in position so that the periphery thereof bears against the internal wall of said housing and so that the latter can be rotated about an axis coincident with the axis of said button, as will be explained hereinafter.

Figure 10:
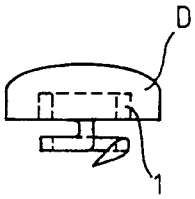
FIGS. 10 and 11 are views of two jewellery item of different shape.
Figure 11:
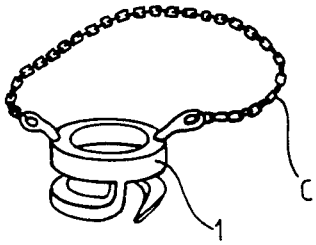

The cylindrical body may be made from a material and with an external shape such that it can serve itself as a jewellery item designed to be fitted directly to a button. Alternatively, this same cylindrical body can serve as a support, for example through its end 2, for a decorative or jewellery item, like that in FIGS. 10 and 11, for example. In FIG. 10 is shown one example of the use of the cylindrical body 1 as a support for an ornamental or decorative item D which caps said cylindrical body 1 whereas FIG. 11 illustrates using said body 1 for fixing a chain C that can serve as a tie chain, for example, or a chain for a pocket watch, etc.

In all cases the end 2*a* opposite the end 2 is joined by its periphery to a lug or tang 3 extending in the direction of one of the generatrices of said cylindrical body or lying in a plane containing one of these generatrices, this tang or lug perpendicular to the end 2*a* constituting the start and point of departure of an open ring coaxial with the cylindrical body 1 and in a plane parallel to said end 2*a* at a sufficient distance therefrom to permit free passage of the material V, ending in a short helical ramp having its end 5 formed to a dull point and diverging from said second end *2a*.

When the cylindrical body 1 is totally hollowed out, its internal surfaces serve, as previously stated, as bearing and guide surfaces cooperating with the edge of the button B. On the other hand, when this internal volume is partially hollowed out it is possible to provide simple contact and abutment areas cooperating with three sectors of the periphery of the button B, as shown in FIGS. 5 and 6, for example. The solid parts 6, 7 and 8 thus form said abutments within the remainder of the housing created by the void E between these three abutments.

Figure 7:
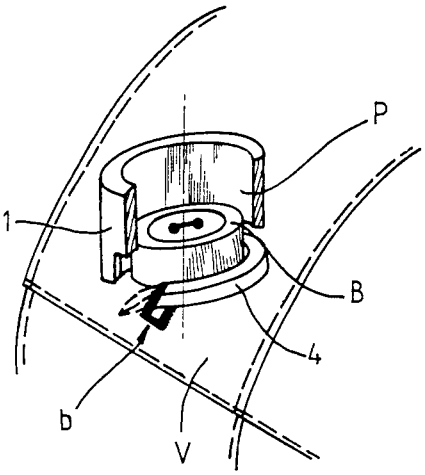
FIGS. 7, 8 and 9 are perspective views showing various positions during the fitting of a device in accordance with the invention onto a button passed through a buttonhole.
Figure 8:
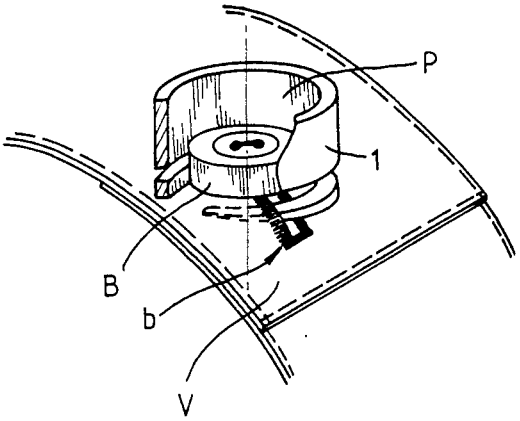
Figure 9:
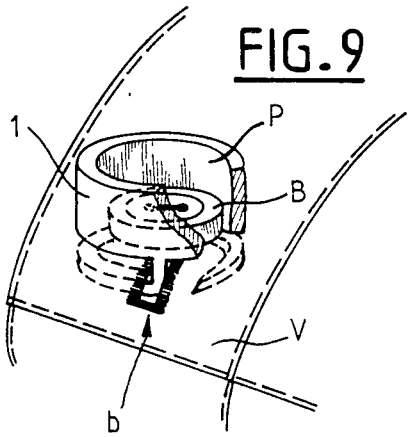

The device in accordance with the invention is used in the following way: when the button B has already been passed through the buttonhole b, the device in accordance with the invention is offered up so as to insert its dull point 5 between the lips of said buttonhole, as schematically represented in FIG. 7. Once this insertion has been done, the button B bears all round its periphery on the internal wall P of the cylindrical body 1 (FIGS. 7, 8 and 9). On imparting one revolution of rotation about an axis that is necessarily the same as that of said button B, the pointed ramp (5) followed by the open ring (4) passes progressively between the lips of the buttonhole b until the end of travel is determined by the lug 3 abutting against said lips, which rise up to each side of the lug 3 by virtue of the inherent elasticity of the material forming the buttonhole, so immobilising the jewellery item appropriately oriented on the garment V.

The item thus mounted on the button B caps the latter and constitutes an ornamentation for it. It can only be removed from it by moving the lip of the buttonhole situated on the side of the opening in the ring below the latter so as to escape from the abutment (lug 3) and so enable the operations and movements that are the opposite of those which have just been described. Even if this button B were to be detached from the garment V to which the device in accordance with the invention is fixed, the latter could not be entrained with the button because it is engaged with the back of the buttonhole b and to detach it therefrom it would be necessary to tear the buttonhole.

The embodiment of the device in accordance with the invention contributes not only to the ornamentation of a button but also to providing the user with a guarantee against possible loss of this device, the latter having a supplementary attachment point to the buttonhole through which said button passes, the button itself being engaged with said device.

It is obvious that the present invention has been described by way of non-limiting explanation only and that any beneficial modification may be made thereto, in particular with regard to the substitution of equivalent means, without departing from the scope of the invention.

I claim:

1. A clothing ornamentation device adapted to be fitted to a button inserted in a buttonhole comprising a cylindrical body which is hollow on the inside for housing said button, and which includes contact and abutment areas in the inside periphery of said cylindrical body for maintaining in position said button, the axis of the button serving as a rotation axis for said cylindrical body and the periphery of said button serving as a guide for said rotation, one base of said cylindrical body being adapted as a decorative means or support therefore and an opposite base being provided with a perpendicular lug substantially in the direction of the generatrices of said cylindrical body and constituting the start of an open ring parallel to said opposite base terminating in a short ramp provided with a dull point.

2. The clothing ornamentation device according to claim 1, wherein said cylindrical body comprises on its inside periphery solid parts constituting said contact and abutment areas.

* * * * *